US005406037A

United States Patent [19]

Nageno et al.

[11] Patent Number: 5,406,037

[45] Date of Patent: Apr. 11, 1995

[54] HEADPHONE INCLUDING MEANS FOR MOUNTING BELT-LIKE SUSPENDER

[75] Inventors: Koji Nageno; Masahiro Dohi, both of Tokyo, Japan

[73] Assignee: Sony Corporation, Tokyo, Japan

[21] Appl. No.: 187,059

[22] Filed: Jan. 27, 1994

[30] Foreign Application Priority Data

Feb. 3, 1993 [JP] Japan ..... 5-039380

[51] Int. Cl.[6] ..... H04R 25/00

[52] U.S. Cl. ..... 181/129; 381/187

[58] Field of Search ..... 181/129, 137; 381/183, 381/187, 188; 2/209

[56] References Cited

U.S. PATENT DOCUMENTS 3,919,501 11/1975 Cech et al. ..... 381/183

5,018,599 5/1991 Dohi et al. ..... 181/129

FOREIGN PATENT DOCUMENTS 1476653 6/1977 United Kingdom .

*Primary Examiner*—Khanh Dang

*Attorney, Agent, or Firm*—Jay H. Maioli

[57] ABSTRACT

A headphone includes a headband, at least one headphone unit, a belt-like member and a wind-in mechanism. The headband is made from an elastically deformable material and is of an inverted U-shape. At least one headphone unit is mounted at one of the ends of the headband. When the headphone is fit onto the head a belt-like member is drawn out of the wind-in mechanism and assumes a shape that follows the shape of the head. The belt-like member is mounted in such a way that it stretches between the two ends of the headband. The wind-in mechanism automatically winds in the drawn-out belt-like member. The wind-in mechanism is mounted at a part of the headphone where one end of the belt-like member, one end of the headband and a headphone unit are joined.

5 Claims, 7 Drawing Sheets

HEADPHONE INCLUDING MEANS FOR MOUNTING BELT-LIKE SUSPENDER

BACKGROUND

1. Field of the Invention

The present invention relates to a headphone. More particularly, the present invention relates to a headphone having a belt-like member which is drawn out when the headphone is put on the head.

2. Background of the Invention

In order to obtain the optimum reproduced sound and acoustic effects, it is required of a headphone that the headphone units fit over the ears of the user in the most suitable position. For this reason, in the past, various headphones equipped with adjusting mechanisms with which it is possible freely to adjust the position of the headphone units to suit the size and shape of the user's head and the position of the ears have been proposed.

The present applicant proposed the kind of headphone shown in U.S. Pat. No. 5,018,599. The construction of that headphone will now be explained using FIGS. 1 through 4.

In this headphone, as shown in FIGS. 1 and 2, a pair of headphone units 4 are pivotally mounted on the two ends of an inverted U-shaped headband 1 by way of support members 2 and support arms 3.

The headband 1 includes a plate-like member, having elasticity, formed into an inverted U-shape. It is necessary that the headband be elastic in this way in order that when the headphones are fitted onto the head the headphone units 4 mounted on the ends of the headband 1 are pressed against the ears with a fixed side pressure.

The headband 1, as shown in FIG. 2, is a generally inward-facing flat member, C-shaped in cross-section, and its open side is covered by a cover member 6. A space 7 is provided inside this headband 1. A spring member 9, which links the two ends of a belt-like suspender 8 which will be discussed hereinafter, is accommodated in this space 7.

Support members 2, 2 are mounted on the ends of the headband 1. These support members 2 pivotally support the support arms 3 by means of support shafts 10, and hold the headphone units 4 which are fitted to the support arms 3.

These support members 2 each have an outer part 12 and an inner-side plate 13 so that, like the headband 1, a space 11 is provided inside them. The inner-side plates 13 are each provided with an opening 14.

A suspender 8 is fitted to the headband 1 constructed as described above, as shown in FIG. 1. That is, the two ends of the suspender 8 are respectively drawn into the headband 1 through the openings 14, 14 in the support members 2, 2 mounted on the two ends of the headband 1 and are linked together by the spring member 9. The suspender 8 is strung across in such a way that the middle portion of the suspender 8 becomes, as a head-support portion 15, like a bowstring on the inward side with respect to the headband 1.

When the headphone is fitted onto the user's head, this suspender 8 supports the head by fitting around the head. When the headband 1 is fitted onto the user's head, the headband 1 is spread out and the head-support portion 15 of the suspender 8 is drawn out from inside the headband 1 against the pulling force of the spring member 9. By the suspender 8 fitting around the head along the contour of the head, the head is pressed upon and supported by the suspender 8.

The spring member 9 at all times pulls-urges the suspender 8 toward the inside of the headband 1. The spring member 9 is for providing the suspender 8, which is drawn out when the headphone is fitted onto the head, with a fixed tension. In order that it exert the same pulling force on both ends of the suspender 8, the central portion of the spring member 9 is fixed to the inside of the top of the headband 1.

The headphone units 4, as shown in FIG. 2, each have a housing part 16, made from natural wood, and a speaker unit 17. Each housing part 16 includes a front side, to the central portion of which the speaker unit 17 is fitted, and a rear side. A sound absorbing material is accommodated inside the housing part 16. Multiple sound radiating holes are provided in the front side of the housing part 16.

These headphone units 4 are fitted to the ends of the headband 1 in the following way:

The headphone units 4 are fitted to the support members 2 on the ends of the headband 1 by way of the support arms 3.

The support arms 3 are pivotally mounted on the support members 2 by way of the support shafts 10. These support arms 3 each have circular arc-form arms **3*a*, 3*b* which extend with the support shaft 10 as their base end. A housing support member 22 is fitted to the ends of these arms 3*a*, 3*b***.

This housing support member 22 is of circular-arc form. Three concave portions 23 are provided on the inner periphery of the housing support member 22, and a cutaway portion 24 is provided in the center of each of these concave portions 23. A buffer grommet 25 is fitted in each of these cutaway portions 24. The housing part 16 is fixed to this housing support member 22 at three points by fixing screws 26 which pass through these buffer grommets 25.

The buffer grommets 25 are made of an elastic material such as plastic. A through hole is provided in the axial-direction central portion of each of the buffer grommets 25. These through holes are for allowing the fixing screws 26 to pass through. The support portions of the buffer grommets 25 are fitted into the cutaway portions 24 and the fixing screws 26 are passed through the buffer grommets 25 and screwed into screw holes 28 provided in the front side of the housing part 16. As a result, the headphone unit 4 is supported by the housing support member 22. Consequently, by means of the elastic deflection force of the buffer grommets 25, non-alignment of the screw holes 28 with the cutaway portions 24 of the housing support members 22, caused by shrinkage in the housing part 16, can be tolerated.

Ear pads 29 are fitted in such a way as to cover the front sides of the housing support members 22 which support the headphone units 4, and make the headphone set more comfortable to wear.

However, in the case of the headphone shown in FIGS. 1 through 4, it is necessary for the spring member 9 to be built into the inside of the headband 1. For this reason, it becomes necessary for the headband 1 to be made up of two or more members. Also, it is necessary for the suspender 8 to be passed through the insides of the headband 1 and the support members 2 after being linked to the spring member 9, and the assembly work has been complicated. And, because the number of parts in the headphones is increased, there has been the danger of the weight of the headphones increasing. Furthermore, because the spring member 9 is built into the headband 1, the width and the thickness of the headband 1 have been large. As a result of this, in the design of the headphones, building the spring member into the headband has placed limitations on the headphone design.

SUMMARY OF THE INVENTION

It is, therefore, an object of the present invention to provide a headphone which resolves the above-mentioned problems.

According to the present invention, there is provided a headphone including a headband, at least one headphone unit, a belt-like member and a wind-in mechanism. The headband is substantially inverted U-shaped in cross-section. At least one headphone unit is fitted to one of the two ends of the headband. The belt-like member is a belt-like member which by the headphone being fitted onto the head is drawn out and assumes a shape such that it follows the shape of the head. The belt-like member is mounted stretchingly across between the two ends of the headband. The wind-in mechanism automatically winds in the drawn-out belt-like member. The wind-in mechanism is mounted on at least on one end of the headband where one end of the belt-like member, one end of the headband and the headphone unit are joined.

According to this invention, by providing a wind-in mechanism, it is possible to provide a headphone with improved assemblability.

According to this invention, by mounting a wind-in mechanism inside a support mechanism, it is possible for the headband to be given any desired shape.

BRIEF DESCRIPTION OF THE DRAWING

The invention will be more readily understood with reference to the accompanying drawings, wherein.

DESCRIPTION OF THE INVENTION

Figure 5:
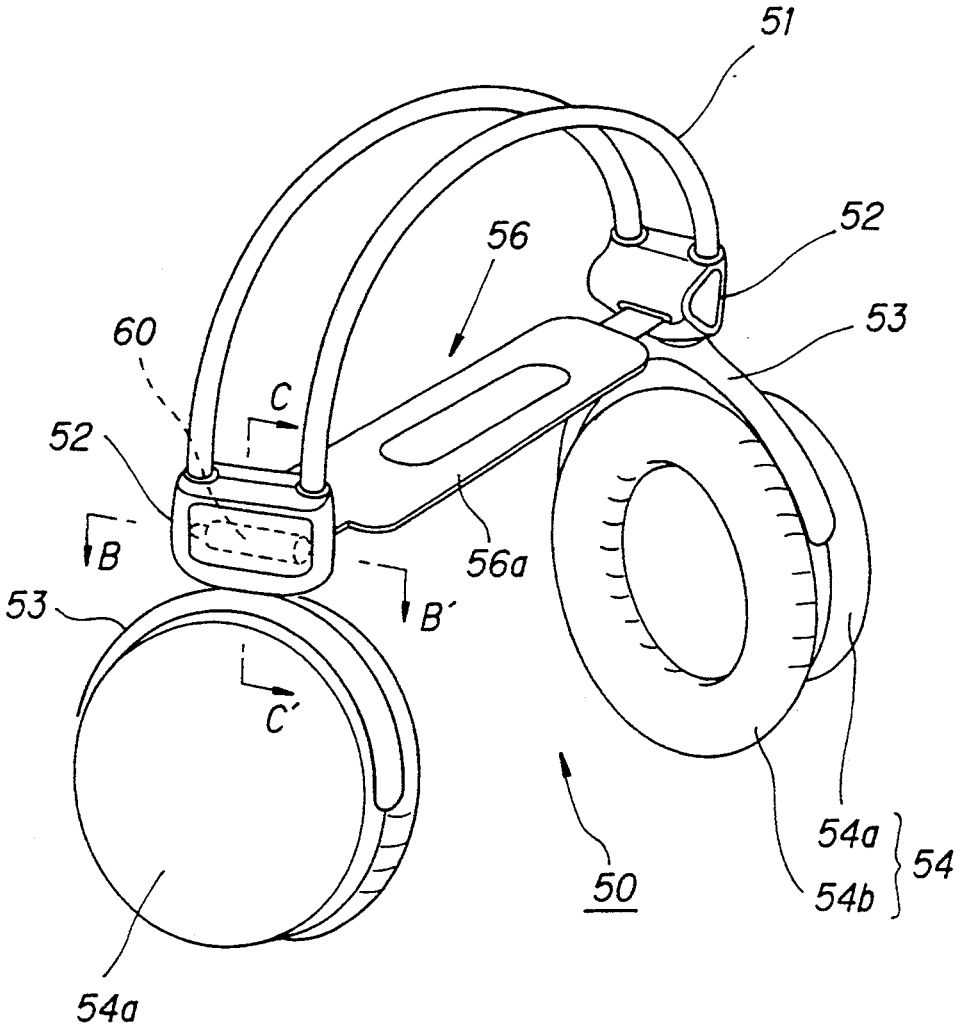
FIG. 5 is an exterior perspective view showing the construction of a headphone according to the present invention.

A headphone according to the present invention will now be explained in detail using the accompanying drawings. FIGS. 5 through 8 show a headphone according to a preferred embodiment of the present invention. FIG. 5 is a perspective view showing the exterior of a headphone 50 according to a preferred embodiment of the present invention. In FIG. 5, reference numeral 51 denotes a headband; this headband is formed in a substantially inverted U-shape using tubular members or cylindrical members. In this preferred embodiment the headband 51 includes a pair of bar-like members. A pair of support members 52, 52 in each of which a wind-in mechanism, which will be discussed hereinafter, is mounted, are mounted on the two ends of this headband 51. The support members 52, 52 are each made up of a concave main body part and a cover part which covers the open side of the concave main body part. As a result, a space of predetermined size is created inside each support member 52. The ends of the headband 51 are fixed to the insides of the main body parts of the support members 52, 52 by screws or the like. An opening **52*a* for a suspender, which will be discussed hereinafter, to pass through, is formed in the cover part of each of the support members 52, 52**.

Two holding parts 53, which rotatably hold two headphone units, which will be discussed hereinafter, are mounted on the bottom sides of the support members 52, 52 in such a way that they are integral with the support members 52, 52. The holding parts 53 each have a pair of arm portions, and a head unit is held between these arm portions.

Reference numeral 54 denotes a headphone unit, and each headphone unit has a housing **54*a* and an earpad 54*b*. The housing 54*a* is made from a material such as plastic or wood and is cup-shaped. A speaker unit, not shown in the drawings, is housed inside the cup-shaped housing 54*a*. The earpad 54*b* is fitted to the speaker sound-radiating surface side of the housing 54*a*. The earpad 54*b* includes a base material such as urethane which is air permeable and its outer surface is made of a material such as leather which is not air permeable. Although not shown in the drawings, a protector in which multiple holes are formed is fitted to the sound-radiating side of the speaker unit, and protects the sound-radiating surface of the speaker unit. The headphone unit 54 is supported by the pair of arm portions of the holding part 53 in such a way that when the headphone is fitted onto the head the headphone unit 54** can pivot to match the angle of the ear with which it abuts.

Reference numeral 56 denotes a suspender which is a bendable belt-like member. The suspender 56 is made from a material that does not expand or contract in the direction of its length but does expand and contract to some extent in the widthways direction and adapt to fit the contours of the head.

Figure 6:
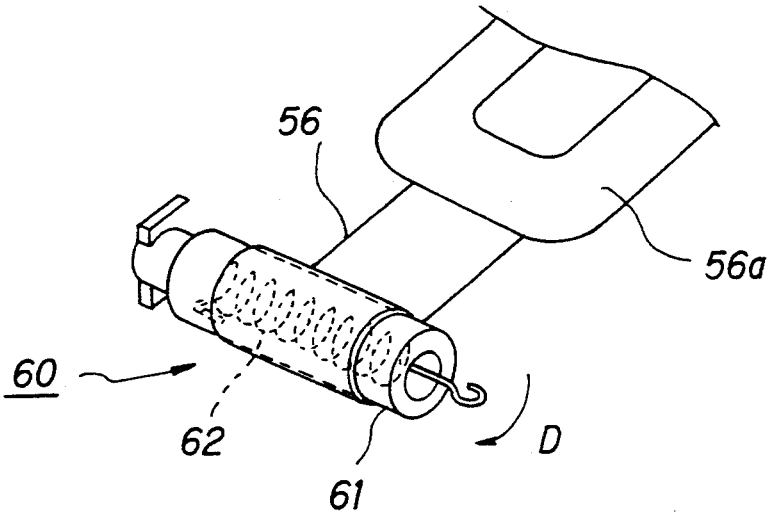
FIG. 6 is a view showing the construction of a wind-in mechanism according to the headphone of this invention.

As shown in FIGS. 5 and 6, a width-enlarger part **56*a* is mounted on the portion of the suspender 56 which abuts the head. Both of the ends of the suspender 56** are attached to wind-in mechanisms which are discussed hereinafter.

Figure 7:
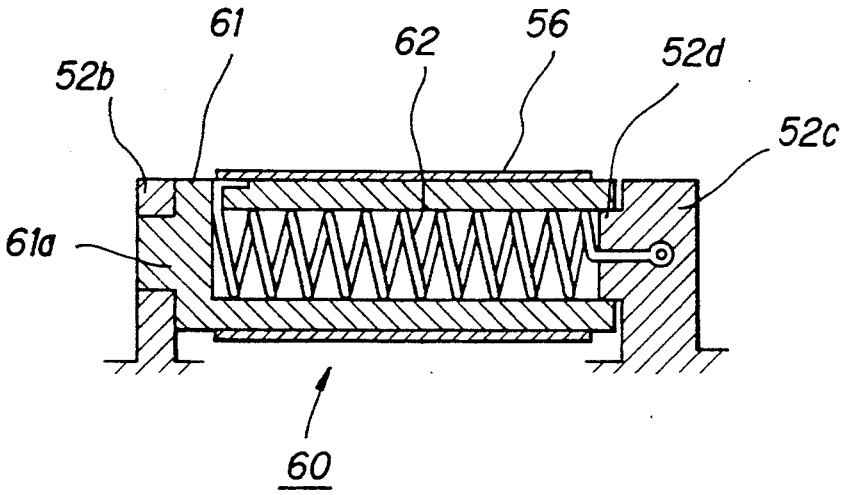
FIG. 7 is a cross-sectional view taken along the line B—B' in FIG. 5.
Figure 8:
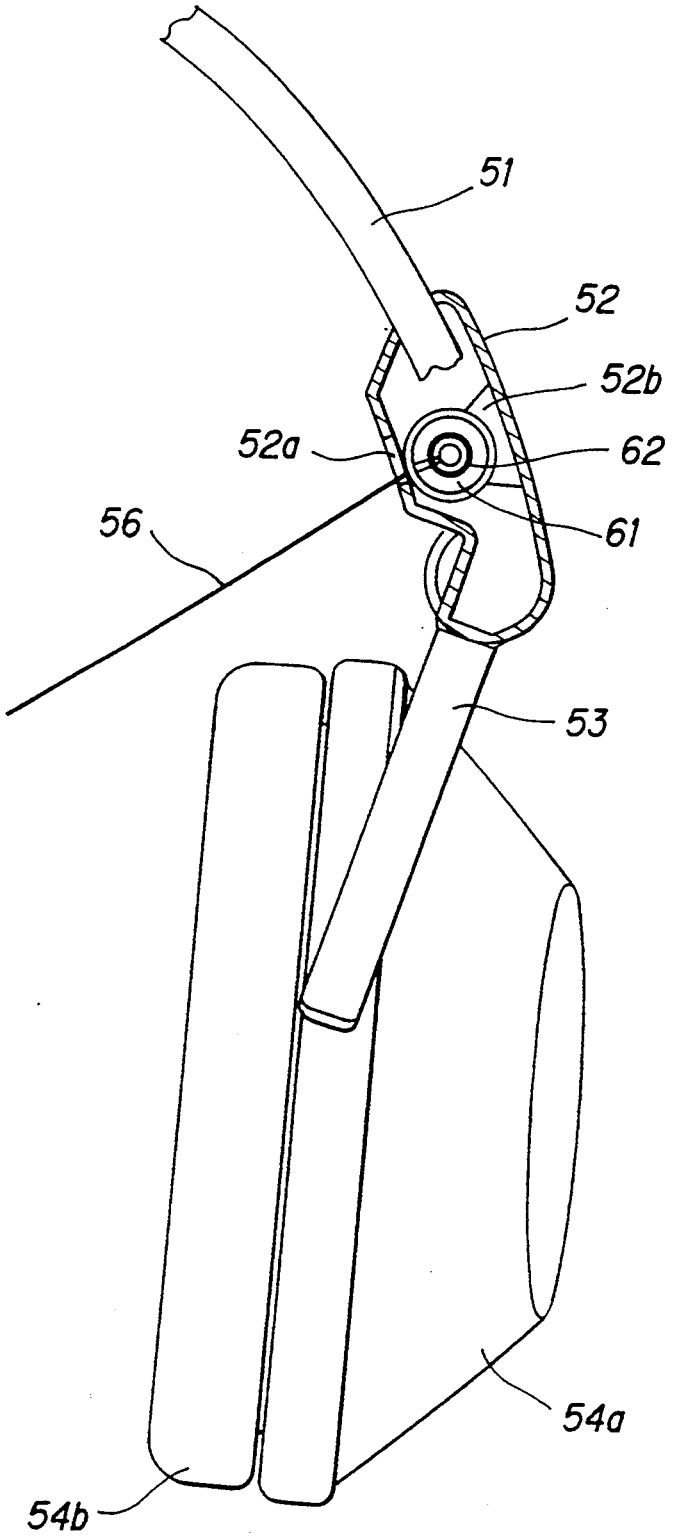
FIG. 8 is a cross-sectional view taken along the line C—C' in FIG. 5.

Reference numeral 60 denotes suspender 56 wind-in mechanisms disposed in the spaces inside the pair of support members 52. The wind-in mechanisms 60 each have a hollow cylindrical drum 61 and a coil spring 62. At one end of the drum 61 a shaft portion **61*a*, which constitutes the rotation shaft of the drum, is formed in such a way that it projects out from the end surface of the drum 61. At the other end of the drum 61 an opening which is continuous with the hollow interior of the drum is formed. The coil spring 62 is housed inside the drum 61 along the axial direction of the drum 61. As shown in FIG. 7, a projecting wall portion 52*b* having a mating hole which mates with the shaft portion 61*a* of the drum 61 and another projecting wall portion 52*c* provided with a shaft portion 52*d* which mates with the opening in the drum 61*a* are formed on and project from the inner surface of the supporting member 52**. As shown in FIGS. 7 and 8, the drum 61 is rotatably supported by means of the mating of the shaft portion 61*a* and the mating hole in the projecting wall portion 52*b* and the mating of the opening in the drum 61 and the shaft portion 52*d* of the projecting wall portion 52*c*. One end of the coil spring is attached to the inner wall of the hollow interior of the drum 61, and the other end is attached to the projecting wall portion 52*c*. As a result, the drum 61 is at all times urged in the direction in which it winds in the suspender 56 when it moves, i.e. the direction indicated by the arrow D in FIG. 6, by the coil spring 62.

As shown in FIG. 6, the suspender 56 is wound around the outer surface of the drum 61. The end of the suspender 56 is fixed to the outer surface of the drum 61 using adhesive or is attached to the drum by a groove being created in the outer surface of the drum 61 and the end of the suspender 56 being inserted into and fixed in the groove.

The operating state of the headphone 50 of the present invention will now be explained.

Figure 1:
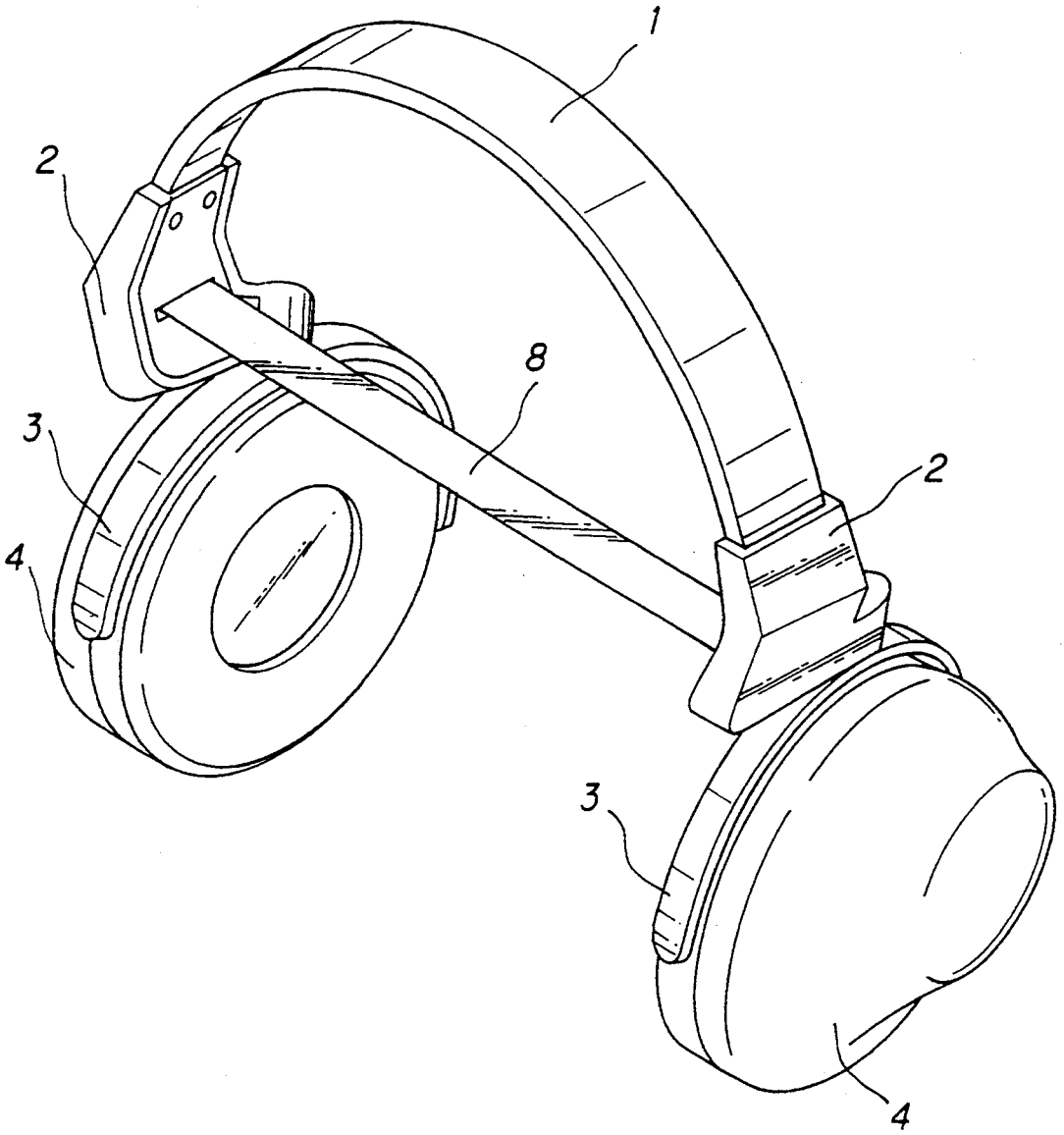
FIG.1 PRIOR ART
FIG. 1 is an exterior perspective view showing the construction of a conventional headphone.
Figure 2:
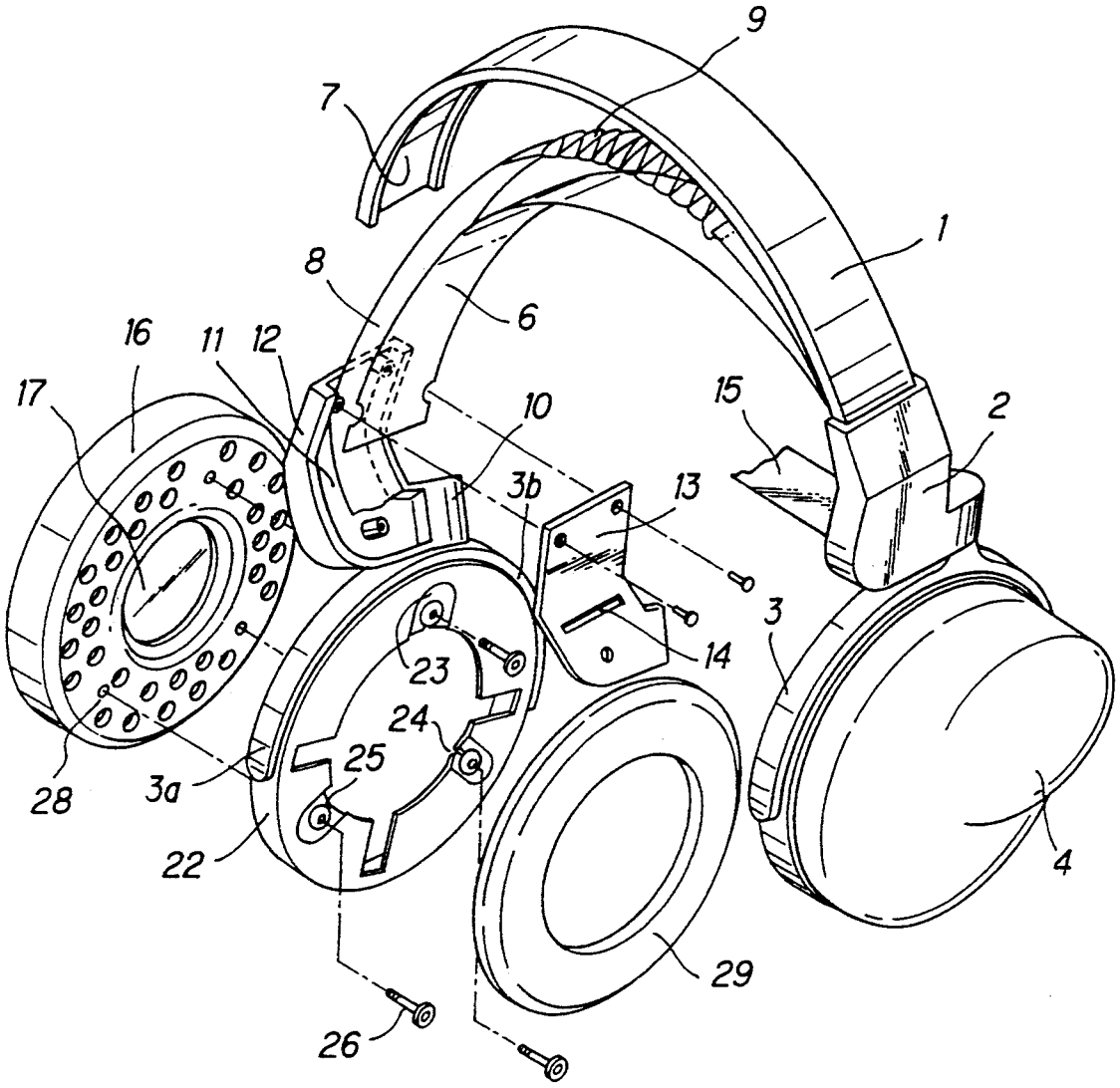
FIG.2 PRIOR ART
FIG. 2 is a partial exploded perspective view of a conventional headphone.
Figure 3:
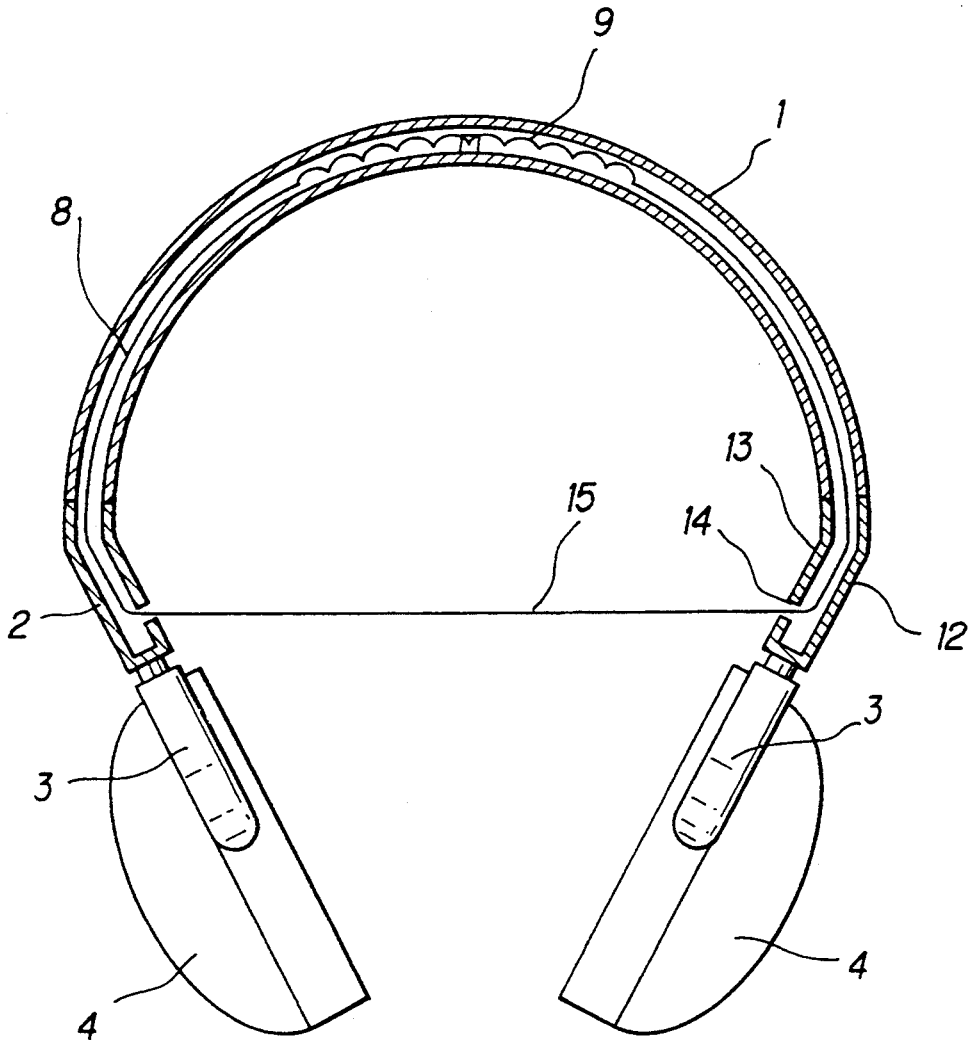
FIG. 3 PRIOR ART
FIG. 3 is a vertical cross-sectional view showing the construction of the headband of a conventional headphone as seen before fitting onto the head.
Figure 4:
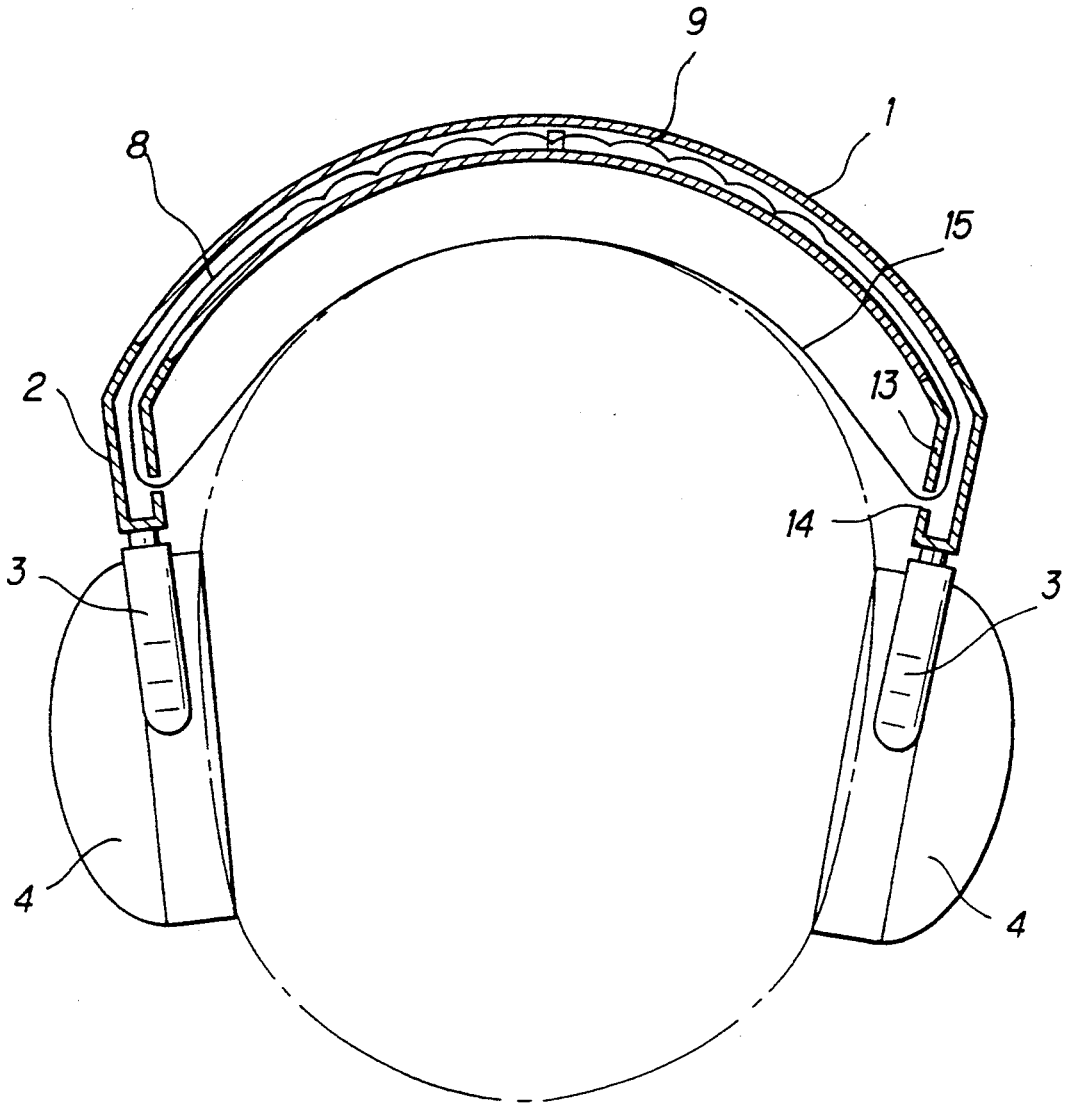
FIG. 4 PRIOR ART
FIG. 4 is a vertical cross-sectional view showing the construction of the headband of a conventional headphone as seen after fitting onto the head.

In the state that the headphone is in before it is fitted onto the head, as described above the suspender 56 is at all times urged in the wind-in direction by the coil spring 62 of the wind-in mechanism 60. That is, the suspender 56 is given a constant tension by the coil springs 62 of the two wind-in mechanisms 60 mounted in the two support members 52, and is pulled in a way similar to that in the case of the headphone shown in FIG. 3. When from this pre-fitting state the headphone 50 is to be fitted onto the head, the headband 51 is spread out and the headphone is fitted over the head. While this is being done, against the urging force of the coil springs 62 of the wind-in mechanisms 60, the suspender 56 is drawn out from inside the support members 52 through the openings 52*a*. The drawn-out suspender 56 bends and fits around the contour of the head, and the head is pressed upon and supported by the urging force of the coil springs 62. At this time, the headphone units 54 pivot along the user's ears, and come into abutment with the ears. As a result, the headphone 50 is fitted onto the head. The width-enlarger part 56*a* on the suspender 56 is positioned over the upper part of the head, and a feeling of stable fit is obtained.

By the head being supported by the suspender 56 whose length can be varied, the head can be pressed down upon and supported at all times by a fixed tension exerted on the suspender 56 drawn out from inside the support members 52 without being affected by the distance from the top of the user's head to the user's ears. When the headphone 50 is removed from the head, the suspender 56 is wound onto the drum 61 by the coil springs 62 of the wind-in mechanisms 60 and returns automatically to the pre-fitting state.

Therefore, because it becomes unnecessary for a mechanism for taking in the suspender 56 to be mounted in the headband 51 itself, the headphone assembly work is made simpler. Because it becomes unnecessary for a mechanism for taking in the suspender 56 to be mounted in the headband 51, the structure of the headband can be made simple, and the weight of the headband can be reduced. Reductions in the weight of the headband lead to reductions in the weight of the headphone. Furthermore, not only does the structure of the headband become simpler, but also the degree of freedom with which the shape and the materials of the headband can be selected is increased.

In the preferred embodiment described above, a construction in which wind-in mechanisms 60 are mounted inside both of the support members 52, 52 is shown; however, a wind-in mechanism 60 may alternatively be mounted in just one of the support members 52. In this case, one end of the suspender 56 is attached to the drum 61 of the wind-in mechanism 60 mounted in one of the support members, and the other end can be fixed with adhesive or screws or the like inside the other support member 52. Also, in place of the coil spring 62 of the automatic wind-in mechanism 60, a twist spring can be used to urge the drum 61 in the direction in which it winds in the suspender 56 when it moves.

Needless to say, various modified constructions, other than the construction disclosed in the preferred embodiment described above, can be employed.

What is claimed is:

1. A headphone comprising:
   - a headband having two ends and having an inverted U-shape;
   - a headphone unit mounted on at least one of the two ends of said headband;
   - a belt-like member having two ends mounted between the two ends of said headband, wherein the two ends of said headband are respectively joined with the two ends of said belt-like member; and
   - a wind-in mechanism which automatically winds in said belt-like member, said wind-in mechanism being mounted at a location where one end of said belt-like member, one end of said headband and said headphone unit are joined, whereby said belt-like member is drawn out of said wind-in mechanism when said headphone is fitted onto the head of a user and said belt-like member assumes a shape of the head, and wherein said wind-in mechanism comprises a cylindrical rotating drum having one end of said belt-like member attached thereto and which winds in said belt-like member.

2. A headphone according to claim 1, wherein said wind-in mechanism further comprises an urging member attached to said cylindrical rotating drum for constantly urging said rotating drum in a direction of winding in said belt-like member.

3. A headphone comprising:
   - a headband which comprises an elastically deformable member having two ends and having an inverted U-shape;
   - a pair of support parts each mounted at one of the two ends of said headband;
   - a pair of headphone units mounted respectively on said pair of support parts;
   - a belt-like member having two ends mounted respectively between the two ends of said headband; and
   - a pair of wind-in mechanisms attached respectively to the two ends of said belt-like member for automatically winding in said belt-like member, each of said pair of wind-in mechanisms being mounted inside each of said pair of support parts, and wherein each of said pair of wind-in mechanisms comprises a cylindrical rotating drum having one end of said belt-like member attached thereto for winding in said belt-like member.

4. A headphone according to claim 3, wherein each of said pair of wind-in mechanisms further comprises an urging member attached to a respective cylindrical rotating drum for respectively constantly urging said rotating drum in a direction of winding in said belt-like member.

5. A headphone according to claim 3, wherein said belt-like member comprises two first portions arranged respectively at the two ends of the belt-like member and each attached to one of said cylindrical rotating drums and which are wound in by said pair of wind-in mechanisms and a second portion which is wider than said first portions and which is arranged therebetween.

* * * * *